US005429057A

United States Patent [19]

Buescher

[11] Patent Number: 5,429,057

[45] Date of Patent: Jul. 4, 1995

[54] CANTILEVERED SNACK TRAY BUTTRESSED BY LOWER TORSO

[76] Inventor: John C. Buescher, 960 Laurel Ave., Glendale, Ohio 45246

[21] Appl. No.: 222,576

[22] Filed: Apr. 4, 1994

[51] Int. Cl.[6] ..... A47B 23/00

[52] U.S. Cl. ..... 108/43

[58] Field of Search ..... 108/43, 42, 44, 45, 108/46, 47; 220/914

[56] References Cited

U.S. PATENT DOCUMENTS

| | | | |
|---|---|---|---|
| 2,304,705 | 12/1942 | Pate . | |
| 2,806,609 | 9/1957 | Grobizna . | |
| 2,808,191 | 10/1957 | Cramor | 108/43 X |
| 3,009,613 | 11/1961 | Noland . | |
| 3,090,330 | 5/1963 | Best . | |
| 3,125,825 | 3/1964 | Gaudette | 108/43 X |
| 3,172,636 | 3/1965 | Collior | 108/43 X |
| 3,361,091 | 1/1968 | Inman | 108/43 |
| 3,541,976 | 11/1970 | Rozas . | |
| 3,656,681 | 4/1972 | Goings . | |
| 3,656,683 | 4/1972 | Desmond et al. . | |
| 4,156,484 | 5/1979 | Wischusen . | |
| 4,243,249 | 1/1981 | Gross | 108/43 X |
| 4,497,433 | 2/1985 | Wischusen, III . | |
| 4,715,293 | 12/1987 | Cobbs . | |
| 4,867,331 | 9/1989 | Task . | |
| 4,976,204 | 12/1990 | Konkle | 108/43 |
| 5,052,603 | 10/1991 | Spina . | |
| 5,062,674 | 11/1991 | Magee . | |
| 5,074,222 | 12/1991 | Welch | 108/43 |
| 5,106,156 | 4/1992 | Marquis | 108/43 X |
| 5,110,170 | 5/1992 | Boatwright . | |
| 5,127,339 | 7/1992 | Hoop, Jr. | 108/43 |
| 5,152,398 | 10/1992 | Forestal et al. . | |
| 5,176,274 | 1/1993 | Jenkins . | |
| 5,186,375 | 2/1993 | Plonk . | |
| 5,209,370 | 5/1993 | Pickett . | |
| 5,221,032 | 6/1993 | Bott et al. | 108/43 X |

*Primary Examiner*—José V. Chen

*Attorney, Agent, or Firm*—Wood, Herron & Evans

[57] ABSTRACT

A tray for mounting on the torso of a wearer which includes a tray surface capable of holding objects and a three-point support system employing an anchor tab and two side buttress panels. The tray surface may contain holes for beverage containers, eating utensils napkins or the like. The tray is formed from a relatively rigid sheet of material such as corrugated cardboard or the like and may be printed with indicia such as advertisements.

18 Claims, 2 Drawing Sheets

FIG 3
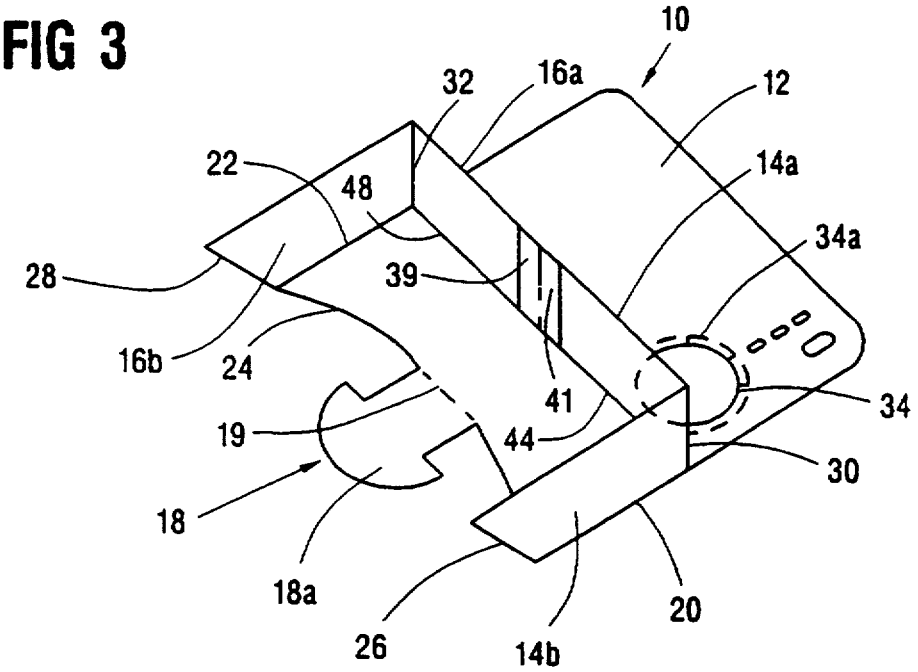
FIG 4
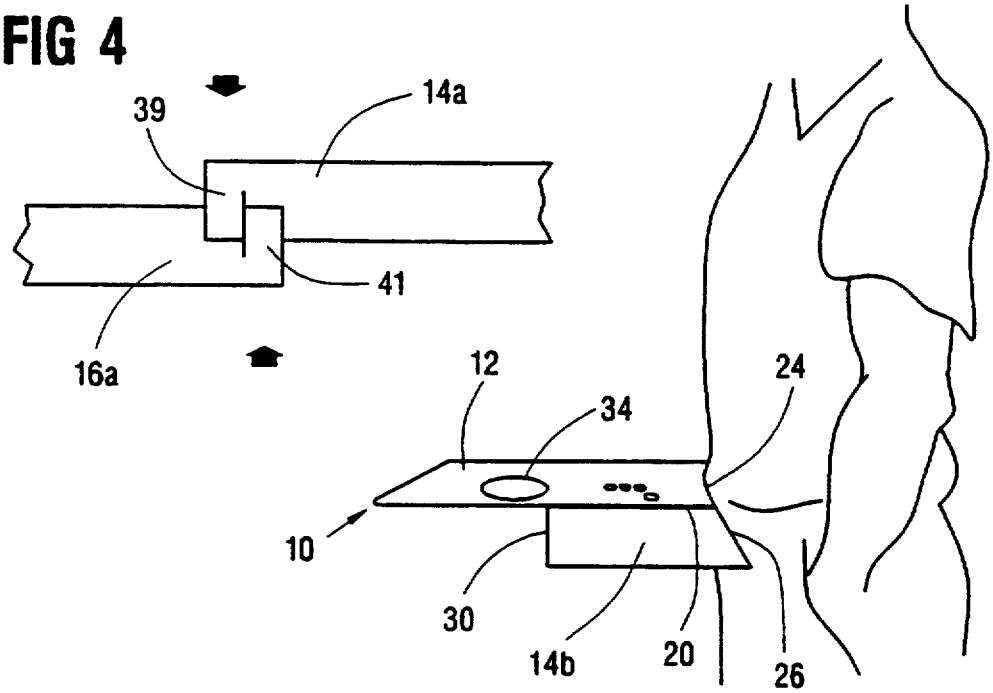
FIG 5

CANTILEVERED SNACK TRAY BUTTRESSED BY LOWER TORSO

BACKGROUND OF THE INVENTION

This invention relates to suspended or supported trays and, more specifically, to trays supported by the human body.

Social gatherings of people such as festivals, parties, etc. often provide food and drink for participants but fail to provide sit-down dining. This causes many people who are standing to have a food plate in one hand and a drink in the other making it difficult to eat in a reasonable way and often increasing the likelihood of spills. In addition, the circumstances, i.e. festive events, call for any solution to this problem to have portability, light weight, ease of use, and disposability.

Portable trays, desks and tables worn at the front of a person's torso for holding a variety of objects, such as cameras, food, writing materials and the like are known in the prior art. Representative examples of prior art torso-mounted trays, desks, and tables are disclosed in U.S. Pat. No. 5,221,032 to Bott, U.S. Pat. No. 3,090,330 to Best, U.S. Pat. No. 3, 125,825 to Gaudette, U.S. Pat. No. 3,541,976 to Rozas, and U.S. Pat. No. 4,715,293 to Cobbs. While all of these prior art devices may function reasonably well under the limited range of conditions for which they were designed, each device has one or more drawbacks and, more particularly, fail to adequately address the above-described problems. For instance, the prior art devices of Bott, Best, Rosas, Cobb, and Gaudette may be too heavy, bulky, overly complicated, difficult to manufacture, and/or indisposable in many circumstances including social gatherings as mentioned above.

Consequently, a need exists for a tray which will alleviate the above-mentioned problems and which is designed for economy, ease of use, and disposability.

SUMMARY OF THE INVENTION

Accordingly, in addition to providing a snack tray for hands-free dining one object of the invention has been to provide a tray having a simple, one-piece construction and which is therefore inexpensive to manufacture and easy to assemble and use.

Another object of the invention has been to provide a light weight tray, which can support the weight of, for example, food and beverage served at a social gathering but is fully and readily disposable after use.

It has been a further object of the invention to provide a compact tray which is foldable for storage and shipping and which is conveniently usable as an advertising medium.

A further object and advantage of the invention is provided by the excellent stability achieved through the use of a three point support system which employs a central anchor tab secured in the wearer's waistband and two side buttresses which are supported by the wearer's lower torso.

To these ends, the present invention comprises a one-piece construction including a top tray panel having, with respect to the wearer, a centrally located, rear anchor tab and two side buttress panels. The anchor tab and side panels initially lie in the same plane as the top tray panel for easy manufacture, storage and shipping, for example, but are then folded downwardly until they are substantially perpendicular to the top tray panel when the device is to be worn. The front ends of the side buttress panels are folded inwardly toward one another and transversely to rear, hinged portions thereof. Outer portions of the front ends are then secured together beneath the top tray panel such that upper edges thereof provide centralized support to the underside of the top tray panel. The anchor tab is tucked into the wearers belt or waistband and includes a widened or divergent outer end which helps retain the tab securely in place.

The top and side panels include rear edges shaped to conform against the wearers body when the device is worn. Specifically, the rear edge of the top tray panel is curved inwardly with respect to the top tray panel and, when the side buttress panels are folded downwardly during use, the rear buttressing edges thereof angle toward the wearer in a direction from the top of each edge to the bottom of each edge. Importantly, the bottom of each rear buttressing edge is a sharp corner which will bear against the user's torso to hold the tray in a horizontal position during use.

Further objects and advantages of the present invention will become readily apparent to those of ordinary skill in the art upon review of the following detailed description of the invention taken in conjunction with the accompanying drawings.

BRIEF DESCRIPTION OF THE DRAWINGS

FIG. 3 is a bottom perspective view illustrating the side panels folded and interlocked under the tray to provide support;

FIG. 4 is a detail of the pre-cut interlocking tabs of the folded side panels Which provide bottom support; and, FIG. 5 is a perspective view of a person wearing the tray and showing the positioning of a side buttress against the wearer's torso.

DETAILED DESCRIPTION OF THE PREFERRED EMBODIMENT

Figure 1:
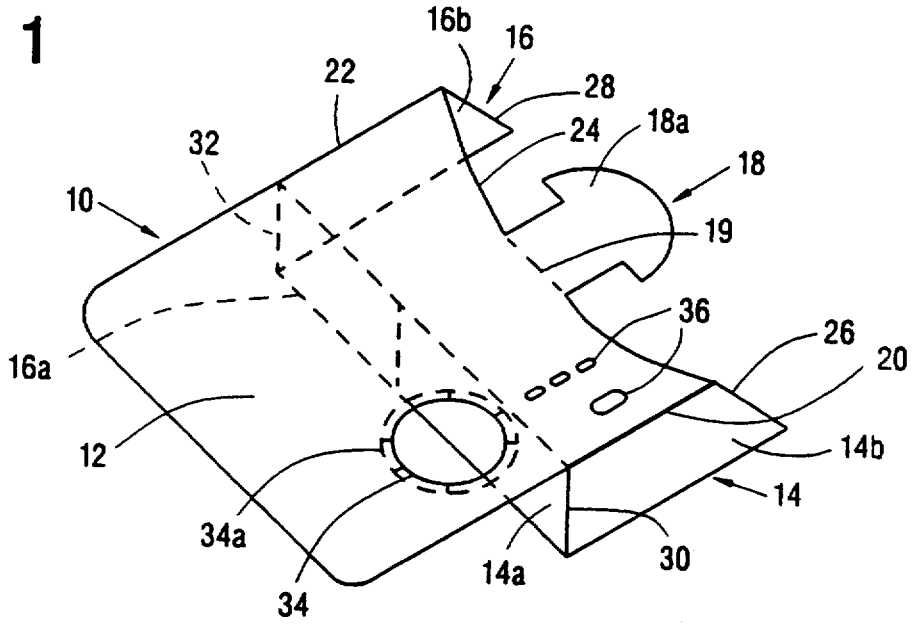
FIG. 1 is a perspective view of the invention assembled and ready for use.
Figure 2:
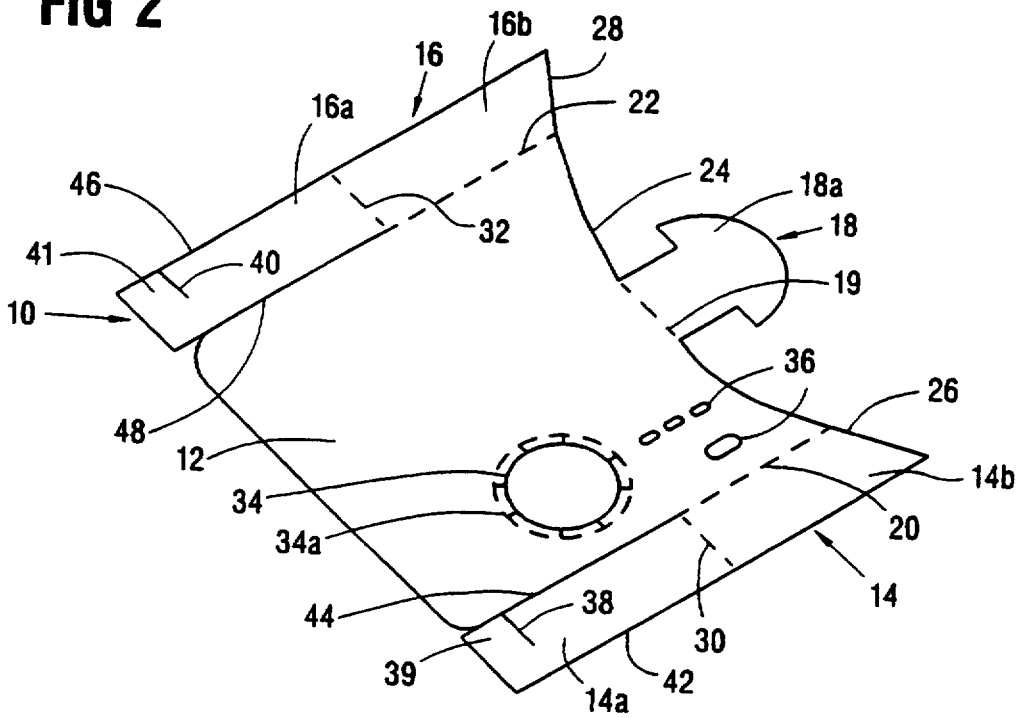
FIG. 2 is a perspective view of the invention as cut or formed from a flat blank.

Referring first to FIGS. 1–3, tray 10 includes a top panel 12, side buttress panels 14, 16 and a central anchor tab 18 having an outer widened and generally arrow-shaped portion 18*a*. Side buttress panels 14, 16 and anchor panel 18 each initially lie in a common plane with top panel 12 as shown in FIG. 2. Anchor tab 18 is connected to a rear central portion of top tray 12 by a fold line 19. Side buttress panels 14, 16 are connected to respective sides of top panel 12 by fold lines 20, 22 but also include unhinged front portions 14*a*, 16*a* in addition to the rear hinged portions 14*b*, 16*b* created by fold lines 20, 22.

Rear edge 24 of top panel 24 is shaped concavely or curves inwardly with respect to top panel 12 and rear side panel buttressing edges 26, 28 are angled outwardly with respect to each other and generally follow the curvature of edge 24 when tray 10 is laid flat as in FIG. 2. When folded for use as shown in FIG. 1, rear side panel edges 26, 28 angle outwardly toward the wearer in a direction from a top of each edge 26, 28 to a bottom of each edge 20 26, 28. The bottom of each edge 26, 28 forms a sharp corner for bearing against the wearer's torso during use and maintaining tray 10 in a horizontal orientation (FIG. 5).

As further shown best in FIGS. 1 and 2, hinge lines 20, 22 respectively start at the junctures of edges 26, 28 and edge 24 and end approximately midway along top panel 12. Side panels 14, 16 each also contain hinge or fold lines 30, 32 each being perpendicular to respective hinge or fold lines 20, 22 such that front end portions 14a, 16a of side panels 14, 16 may be folded along hinge or fold lines 30, 32 toward one another and toward a central portion of top panel 12. By means further discussed below, front end portions 14a, 16a are releasably attached to one another approximately at a central portion of top panel 12. Outer end portions 14a, 16a of side panels 14, 16 thus fold together at a 90° angle with respect not only to hinged portions 14b, 16b but also with respect to top panel 12. It will be appreciated that end portions 14a, 16a, when affixed to another, will provide support for top panel 12 and, in addition, hold hinged portions 14b, 16b in a perpendicular relationship to top panel 12 and therefore allow hinged portions 14b, 16b and, more particularly, edges 26, 28 thereof to act as buttresses against the torso of the wearer as shown in FIG. 5.

As further shown in FIGS. 1 and 2, top panel 12 also includes a hole 34 which is designed to be used as a receptacle for beverage containers and the like and which may be extended by folding or tearing away perforated extension portion 34a. Top panel 12 also has slots or holes 36 which may be used as receptacles for rolled up napkins, eating utensils, or other articles to be used in conjunction with tray 10. Conveniently, one of the holes 36 may be used as a thumb hole for carrying tray 10 when it is not desired to be worn. The remaining surface area of top panel 12, which faces upwardly, as well as outwardly facing surfaces of hinged side panel portions 14b, 16b, may be used as a surface for print media such as advertising, etc.

Turning now to FIGS. 2–4, the preferred means for fastening front end portions 14a, 16a of side panels 14, 16 takes the form of slots 38, 40 in respective outer end portions 14a, 16a which define respective fastening tabs 39, 41. Slots 38, 40 are each perpendicular to edges 20, 22 when tray 10 is in a flat state as shown in FIG. 2. Slot 38 extends inwardly from outside edge 44 of front end portion 14a while slot 40 extends inwardly from outside edge 46 of front end portion 16a. Slots 38, 40 each extend to a position about midway between respective outside edges 42, 44 and 46, 48 of front end portions 14a, 16a. In order that they may be affixed together as shown in FIGS. 3 and 4, slot 38 extends inwardly from edge 44 away from the adjacent top panel 12 whereas slot 40 extends inwardly from outside edge 46 toward top panel 12. Thus, when front end portions 14a, 16a are affixed together below top panel 12, edges 44 and 48 create a supporting top edge of connected front end portions 14a, 16a in contact with the undersurface of top panel 12. Edges 44, 48 thereby act together as a forward support fulcrum for the tray surface or top panel 12 while, in addition, holding the side panel hinged portions 14b, 16b in a vertical position for buttressing against the user's torso as shown in FIG. 5.

The entire tray 10 may be formed by, for example, cutting or stamping a single sheet of corrugated cardboard or pasteboard in the case of a disposable model, or a more rigid and durable sheet material such as a plastic or polymeric material for a more permanent article. Either model may be preprinted with indicia such as advertisements, etc. An optimum width for top panel 12 has been found to be approximately 8 inches.

Operation

Snack tray 10 is easily assembled by folding side panels 14, 16 downwardly with respect to top panel 12 to approximately a 90° angle with respect thereto and again folding front end portions 14a, 16a transversely to hinged portions 14b, 16b at fold lines 30, 32 inwardly toward one another and beneath top panel 12. In the embodiment shown, front end portions 14a, 16a are perpendicularly oriented both with respect to top tray panel 12 and to respective hinged portions 14b, 16b as best shown in FIGS. 1 and 3. Subsequently, front portions 14a, 16a are affixed to one another by fastening tabs 39, 41 together and, specifically, by inserting slot 38 into slot 40. With the top panel 12 and, more particularly, edge 24 thereof placed against the front of a wearer's torso, anchor tab 18 is inserted into the wearer's waistband and held in place by outer portion 18a. Top panel 12 is pushed forward and downwardly to cause anchor tab 18 to fold at hinge line 19 which at least substantially follows edge 24. As tray 10 is placed in a horizontal position, edges 26, 28 of side panels 14, 16 come into contact with the wearer's lower torso thereby causing tray 10 to stabilize in a horizontal position against the wearer's body.

Thus, items placed on top panel 12 will be supported through the stability provided by outer end portions 14a, 16a due to the fulcrum support provided by contact of edges 44, 48 with the bottom surface of top panel 12 as well as support provided by hinged portions 14b, 16b and edges 26 and 28 thereof which buttress against the wearer's torso and, finally, the support provided by anchor tab 18. By way of this unique support system, tray 10 remains remarkably steady even when the wearer is walking.

From the foregoing description, many advantages of the present invention will become readily apparent to those of ordinary skill in the art. For example, the one piece design of tray 10 eliminates the cost of many more complicated multipiece systems and those systems which include the use of many different materials. Also, construction from a single sheet of material allows inexpensive mass production of the tray by cutting, stamping and the like. Finally, the tray may be made of disposable or durable material, to be used at crowded events and still provide very good stability due to the three point suspension system.

Although a preferred embodiment of the invention has been described above, those of ordinary skill in the art will readily recognize many substitutions and/or modifications which may be made thereto without departing from the spirit and scope of the invention. For example, the fastening tabs 39, 41 could easily be replace by other fastening mechanisms such as adhesive disposed on at least one of the front end portions 14a, 16a or fastening tabs 39, 41. Alternatively, Velcro® brand or so-called hook and loop fasteners could be used especially in the case of a more durable tray formed from a sheet of plastic. Front end portions 14a, 16a also need not be folded toward one another so as to be perpendicular to hinged portions 14b, 16b when worn. In this latter regard, front end portions could instead each extend at an angle toward the front of the tray when the device is worn. Furthermore, instead of using the tray as a food and beverage tray, it could alternatively be used as an artist's pallet and have suitable modifications for this purpose. Also, equipped with a retaining lip or receptacle slots to prevent items from falling off, the tray could be used by service personnel who must stand while performing their duties in handling tools, small parts or the like.

Accordingly, it will be appreciated that many modifications may fall within the spirit and scope of the present invention and applicant therefore intends to be bound only by the scope of the appended claims.

What is claimed is:

1. A torso supported tray comprising:

a central top panel having an top surface for supporting objects, a bottom surface, a front edge, a rear edge and a pair of side edges, said rear edge being adapted to abut a wearer's torso;

first and second side buttress panels extending transversely and downwardly from respective side edges of said top panel, said first and second side buttress panels having rear edges which angle rearwardly from a top of each edge to a bottom of each edge;

an anchor tab extending outwardly from said rear edge of said top panel;

said tray being formed from a single, flat sheet of material, wherein said first and second side panels are adapted to be folded transversely and downwardly with respect to said top panel and fixed in a transverse orientation with respect to said top panel and said anchor tab is also adapted to be folded downwardly with respect to said top panel so as to be insertable in a wearer's waistband; and, wherein each side buttress panel comprises a rear portion connected to a respective side edge of said top panel by a foldline and a front portion disconnected from said top panel, said front and rear portions of said side buttress panels are connected together by respective fold lines extending transversely to said side panels, whereby said side buttress panels may be folded downwardly with respect to said top panel and said front portions may be folded inwardly toward one another and beneath said top panel.

2. The tray of claim 1 wherein at least one of said front portions includes a fastener for fastening said front portions together beneath said top panel.

3. The tray of claim 1 wherein said anchor tab is attached to said top panel by a foldline defined along said rear edge.

4. The tray of claim 1 wherein said rear edge of said top panel curves inwardly with respect to said top panel in order to conform to the contour of the wearer's torso.

5. A torso supported tray comprising:

a central top panel having an top surface for supporting objects, a bottom surface, front and rear edges and a pair of side edges;

a side buttress panel extending along each side edge of said top panel, each side buttress panel having a rear portion connected to a respective side edge of said top panel by a foldline and a front portion disconnected from said top panel, said front and rear portions of said side buttress panels being connected together by respective fold lines extending transversely to said side panels, whereby said side buttress panels may be folded downwardly with respect to said top panel and said front portions may be folded inwardly toward one another and beneath said top panel; and, an anchor tab extending outwardly from said rear edge of said top panel.

6. The tray of claim 5 wherein said tray is a formed from a single, flat sheet of material.

7. The tray of claim 5 wherein at least one of said front portions includes a fastener for fastening said front portions together beneath said top panel.

8. The tray of claim 7 wherein both of said front portions include a fastener thereon for fastening said front portions together.

9. The tray of claim 8 wherein said fasteners comprise fastening tabs defined by mating slots in said side buttress panels.

10. The tray of claim 5 wherein said anchor tab is attached to said top panel by a foldline defined along said rear edge.

11. The tray of claim 5 wherein said anchor tab includes an outer end which is wider than an inner end thereof.

12. The tray of claim 5 wherein said rear edge of said top panel curves inwardly with respect to said top panel in order to conform to the contour of the wearer's torso.

13. The tray of claim 12 wherein said side buttress panels include rear edges adapted to engage a wearer's torso, said rear edges of said side buttress panels being angled outwardly with respect to one another and generally following the contour of said top panel rear edge when said tray is in an unfolded condition.

14. The tray of claim 5 wherein said top panel contains a hole for holding an object.

15. The tray of claim 14 wherein said hole is expandable by way of perforations disposed adjacent thereto.

16. The tray of claim 5 wherein said front portions of said side buttress panels each include edges disposed adjacent said side edges of said top panel when said tray is in an unfolded condition but which contact said bottom surface of said top panel and thereby provide support for said top panel when in a folded condition.

17. The tray of claim 5 wherein said tray is formed from a single sheet of cardboard.

18. The tray of claim 5 wherein said tray is formed from a single sheet of plastic.

* * * * *